United States Patent [19]

Oudet

[11] Patent Number: 4,737,753

[45] **Date of Patent: * Apr. 12, 1988**

[54] MULTIPOLAR MAGNETIZATION DEVICE

[75] Inventor: Claude Oudet, Besançon, France

[73] Assignee: Portescap, La Chaux-de-Fonds, Switzerland

[ * ] Notice: The portion of the term of this patent subsequent to Nov. 17, 2004 has been disclaimed.

[21] Appl. No.: 795,939

[22] PCT Filed: Feb. 22, 1985

[86] PCT No.: PCT/CH85/00033

§ 371 Date: Oct. 21, 1985

§ 102(e) Date: Oct. 21, 1985

[87] PCT Pub. No.: WO85/03801

PCT Pub. Date: Aug. 29, 1985

[30] Foreign Application Priority Data

Feb. 22, 1984 [CH] Switzerland ..... 850/84

[51] Int. Cl.[4] ..... H01F 13/00

[52] U.S. Cl. ..... 335/284; 310/90.5; 361/143

[58] Field of Search ..... 335/284; 361/143; 310/152, 90.5

[56] References Cited

U.S. PATENT DOCUMENTS

| | | | |
|---|---|---|---|
| 3,158,797 | 11/1964 | Andrews | 310/152 X |
| 3,423,707 | 1/1969 | Williams | 335/284 X |
| 3,624,572 | 11/1971 | Mallinson et al. | 335/284 X |
| 3,824,516 | 7/1974 | Benowitz | 335/284 |
| 3,885,839 | 5/1975 | Haberman | 310/90.5 |

FOREIGN PATENT DOCUMENTS

| | | | |
|---|---|---|---|
| 56-122112 | 9/1981 | Japan | 335/284 |

*Primary Examiner*—Arthur T. Grimley
*Assistant Examiner*—Jane K. Lau
*Attorney, Agent, or Firm*—Cushman, Darby & Cushman

[57] ABSTRACT

A multipolar magnetization device comprises at least one electric power source, at least two distinct current pulse generating devices and several portions of electric conductors respectively connected to at least four of said conductor portions for producing a given magnetic field portion. The magnetization device is arranged for creating a series of magnetic field portions of successive alternating polarities for producing in a magnetizable body a corresponding series of magnetized zones.

6 Claims, 2 Drawing Sheets

MULTIPOLAR MAGNETIZATION DEVICE

Figure 1:
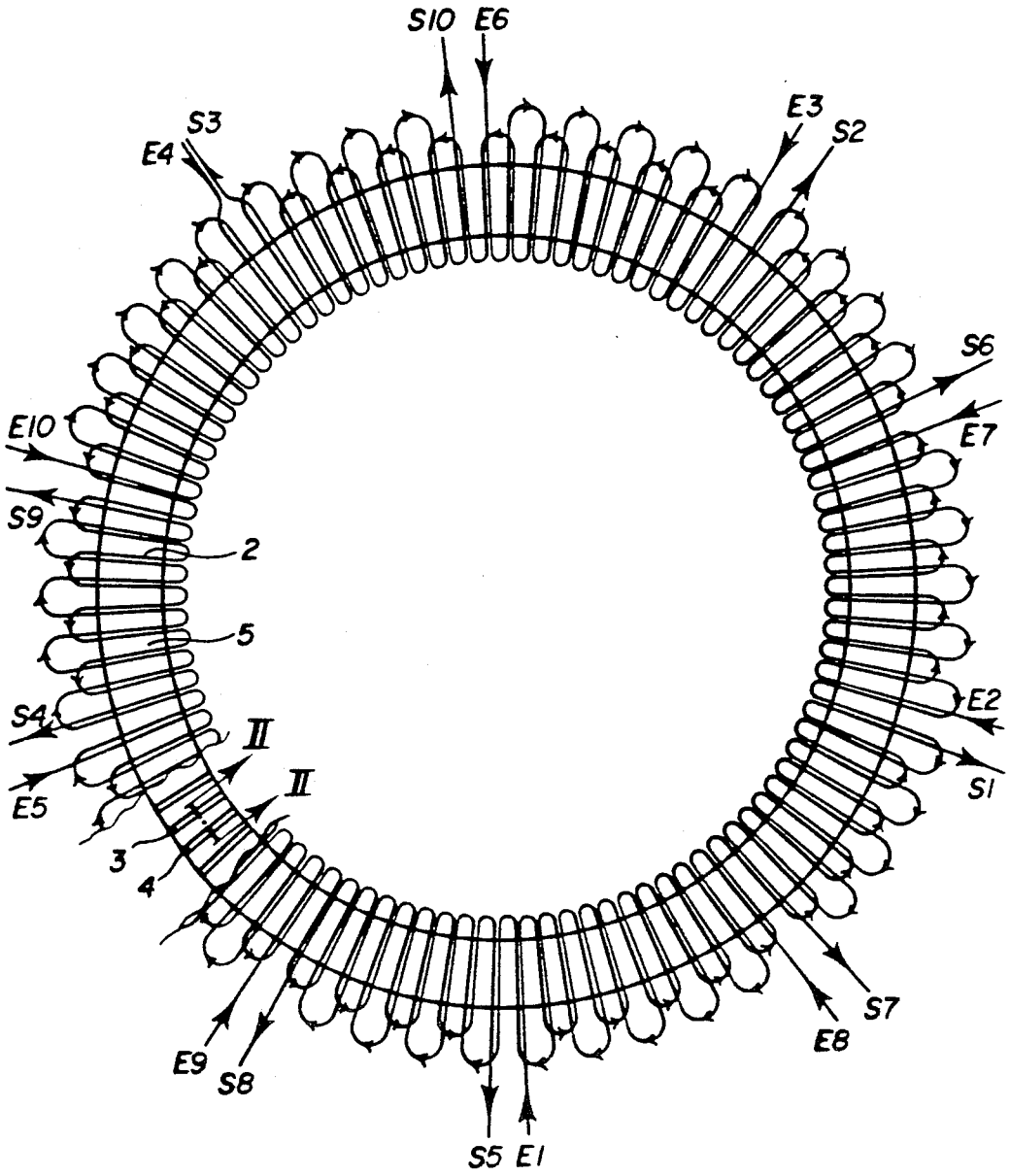

The present invention concerns a multipolar magnetization device for forming on at least one surface of a magnetizable body a series of magnetized zones having successively alternating polarities, comprising at least one source of electric power, at least one current pulse generating device connected to this source, and several elongated portions of electric conductors connected to said pulse generating device and arranged so as to create magnetic fields producing the magnetization of said zones.

In such a device, it is usual to supply the conductors in power from a single current pulse generator, the voltage of which had to be sufficiently high to create the necessary magnetization current.

Such an arrangement presents however major drawbacks when one has to produce on a body of small dimensions, such as a rotor of a stepping motor, a high number of magnetized zones, for example for the purpose of attaining, in the case of such a motor, a high number of steps. As a matter of fact, when the number of zones to magnetize increases for a given volume or surface of the corresponding body, the utilizable copper section and the space available for the insulation of the conductors are reduced accordingly. The result of this is that on the one hand, the problem of the heating of the device becomes very rapidly critical, and that, on the other hand, the permissible working voltage decreases because of the risk of breakdown. Further, in the devices of this type, the homogeneity of the magnetization of the different zones is not satisfactory. As a matter of fact, the portions of conductors producing the respective magnetization fields always exhibit in practice variations in section, therefor of electric resistance, and thus conduct different magnetization currents. The usual power supply, in parallel, of the conductors or groups of conductors does not permit a sufficient homogeneity to be ensured from the moment when it is not possible any more, in particular for reasons of overheating, to saturate the zones to be magnetized by an excess of current. An additional drawback originates from the fact that the usual power supply makes the detection of malfunctioning resulting from a breakdown very difficut, the corresponding variations of the level of current being very small.

The aim of the invention is to remedy the drawbacks and the limitations of known magnetization devices, and in particular to provide a device of the type mentioned at the beginning permitting to magnetize a high number of zones in a reduced space, in a very homogeneous manner.

For this purpose, the device according to the invention is characterized in that said portions of conductors are disposed in such a manner that the magnetization of each zone is produced by the magnetic field generated by at least four portions of conductors connected to at least two distinct pulse generating devices producing approximately equal current pulses.

Other particularities of the invention will become apparent from the description given hereunder and from the appended drawing illustrating an example of realization of the present device.

Figure 2:
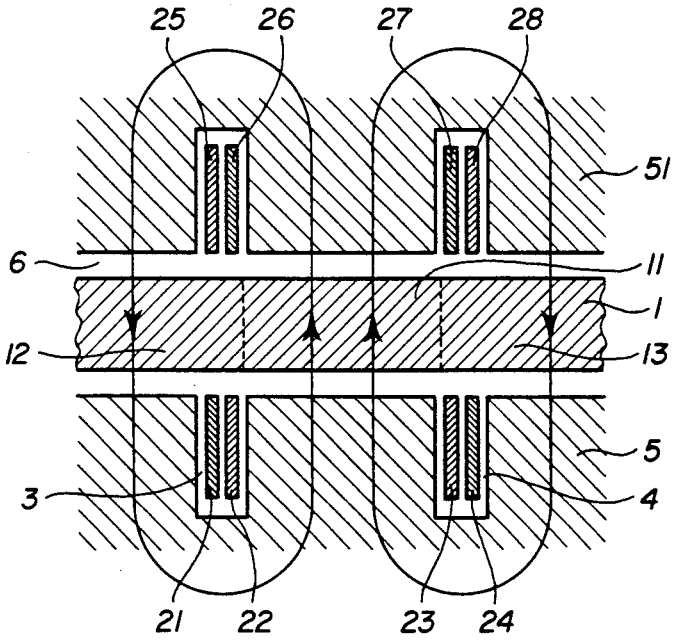
Figure 3:
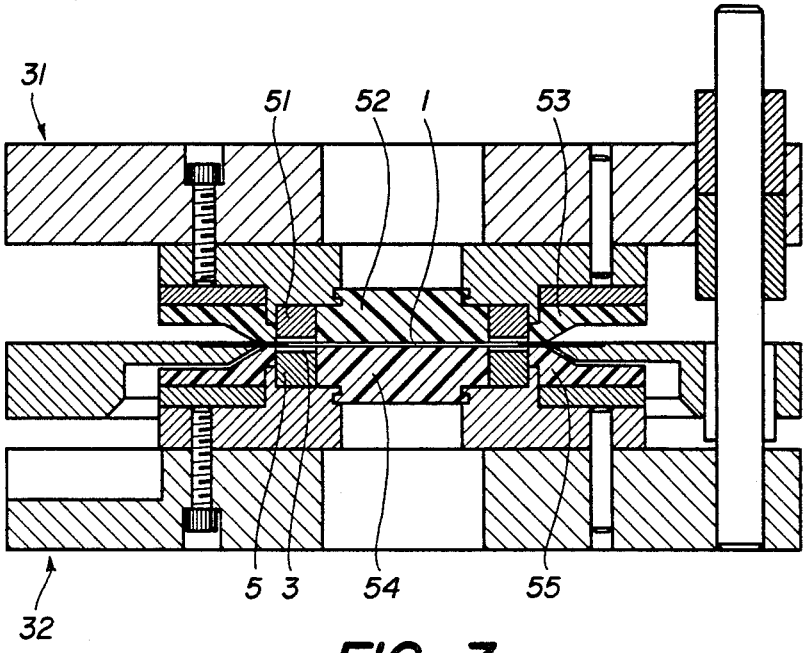

In the drawing,

FIG. 1 is a diagram of the disposition and of the power supply of the electric conductors of the magnetization device, FIG. 2 is a schematic transverse cross-sectional view, along the line II—II of FIG. 1, showing the magnetization of a zone of the body to magnetize, and FIG. 3 is a transverse cross-sectional view of the device in the working state.

The device illustrated in the FIGS. 1 to 3 is intended for the magnetization of a multipolar rotor of a stepping motor, which has the shape of a flat annular disk 1, visible in section in FIG. 2. Elongated portions of conductors, such as 21 to 28, designated as a whole by 2 in FIG. 1, are disposed to be parallel to the disk in the radial direction thereof, so as to produce in the circumferential direction of the disk a series of magnetized zones in the transverse direction, i.e. in the axial direction of the disk.

The magnetization device comprises two annular support parts 5,51 of a highly permeable material, such as an iron-cobalt alloy, between which is placed the flat disk 1 to be magnetized having a small thickness compared to its diameter and made for example of samarium-cobalt. The support parts 5, 51 have respective flat polar surfaces facing disk 1 and comprise each a series of radial slots such as 3 and 4 in which are lodged the corresponding electric conductor portions. These electrical conductors are arranged and connected to electric current sources as described hereafter in relation with FIG. 1.

FIG. 1 shows in plan the support part 5, the outer and inner edges of its annular surface defining the magnetized surface on the rotor disk. As it will become apparent from the following description, this surface consists of a series of elongated zones, radially oriented, and exhibiting alternating polarities on each face of the disk.

The section along the line II—II of FIG. 1 is shown in FIG. 2. Each of the adjoining slots 3, 4 comprises a pair of portions of conductors, respectively 21, 22 and 23, 24. A similar arrangement of the support 51 and of the portions of conductors 25, 26 and 27, 28 is placed facing the first one, so as to form an air gap 6 in which is disposed the disk 1 to magnetize. The ends of the radial portions of conductors are connected as indicates FIG. 1, to form groups of series connected portions of conductors, the ends of each of these groups being connected to the terminals of a respective pulse generating device, not represented. In FIG. 1, the ends of the different groups associated with the support 5 have been designated respectively by $E_1$, $S_1$; $E_2$, $S_2$; $E_3$, $S_3$; . . . $E_{10}$, $S_{10}$. Each group comprises twenty portions of conductors and the support has a total of one hundred slots such as 3 or 4. The different groups are shifted one relatively to the other, so that portions of conductors belonging to two different groups are housed in each slot, these portions being connected in such a way that the magnetization current flows through them in the same direction. In the example of FIG. 1, the groups overlap on one half of their angular width. The conductors of the opposite part 51 are arranged in a similar way, an additional shift, for example by one fourth of their angular width being preferably provided between the respective groups of the two support parts arranged facing each other.

On the other hand, the different pulse generating devices are arranged to provide current pulses of the same amplitude and of the same duration. They comprise essentially, for example, a capacitor, a load resistor mounted in series, and a switch system arranged to connect the capacitor for a determined duration to the terminals of the corresponding group of portions of conductors. The capacitor is preferably charged from a power source common to the totality of the pulse generating devices.

Consequently, in the diagram of FIG. 2, in each pair of portions of conductors, a current originating from two different pulse generators flows in the same direction. Each portion of conductor of a pair is connected in series with a portion of conductor housed in the adjoining slot of the same support part in such a way that the currents flowing through the portions of conductors housed in adjoining slots are in opposite directions. On the other hand, the currents flowing through pairs of portions of conductors housed in slots disposed facing each other are oriented in the same direction. Thus, the magnetic field created by four pairs of portions of conductors such as shown in FIG. 2 has, for example, the direction indicated in this figure by the arrows, and consequently, the magnetization of a zone 11 of the disk 1 delimited by dotted lines is realized in the direction transverse to the disk, bringing about the apparition of poles of opposite names on each of the surfaces thereof. It appears equally from FIG. 2, that the zones adjoining the zone 11 on each side thereof, i.e. the zones 12 and 13, partly visible, are magnetized in a parallel but opposite direction to that of the magnetization of the zone 11.

Owing to the fact that the magnetization of each zone is produced by currents flowing in several portions of conductors, eight in the present example corresponding to at least two, here four groups supplied in power from respectively two distinct pulse generating devices, the influence of the difference between the currents becomes negligible, with the result that an excellent homogeneity of the magnetization from one zone to the other can be achieved.

It should be equally noted, that the separate power supply of the different groups permits to work with a considerably lowered input voltage, which is important for the solution of the problem of the insulation of the conductors and of the optimal utilization of the space available for the conductors themselves.

The arrangement according to FIG. 1 further offers the advantage that the outer connections between the different portions of conductors are realized in such a way that a closed loop is formed around each zone to magnetize, and is parallel to the corresponding surface of the disk to magnetize. This permits a particularly efficient use of the magnetization current. To obtain these closed loops in the represented example, the groups of portions of conductors which overlap are oriented in opposite directions in relation to their connections to the respective pulse generating devices. Thus, for example in the group $E_6$, $S_6$, the current flows along the periphery clockwise, while in the groups $E_2$, $S_2$ and $E_3$, $S_3$ which cooperate with this group $E_6$, $S_6$, the current flows along the periphery in the opposite direction. The connections to the pulse generating devices are represented only schematically in FIG. 1, but it is obvious that in this case, the loop can also be easily closed by an appropriate configuration of the conductors, such as shown, for example at the connections $S_3$, $E_3$.

To reduce the losses of useful magnetic energy, and thus increase the efficiency of the present device, the portions of elongated conductors, preferably of a flat rectangular section utilizing in an optimal way the available space as shown in FIG. 2, are arranged in the slots in such a way that their outer edges are at least approximately at the same height as the edge of the slot.

FIG. 3 shows in axial section, a practical realization of the present magnetization device. One distinguishes in it, in particular the annular support parts 5 and 51 provided with slots such as 3 for the conductors of the magnetization current. The conductors themselves are not visible, the parts surrounding the supports being embedded in a plastic material forming the parts 52, 53, 54, 55. As the FIG. 3 also shows, each of the support parts 5 and 51 is solid with a corresponding assembly 31, 32, these assemblies being separable axially to permit the piece to magnetize 1 to be placed in position and are put in the position of FIG. 3 during the magnetization operation of the device.

I claim:

1. A multipolar magnetization device for forming on at least one surface of a magnetizable body a series of magnetized zones having successively alternating polarities, comprising: at least two distinct current pulse generating devices connected to said source, and several elongated portions of electric conductors connected to said pulse generating devices and arranged so as to create a series of magnetic field portions of successively alternate polarity, said portions of conductors are disposed in such a manner that each magnetic field portion of said series is generated by at least four of said portions of conductors respectively connected to at least two distinct pulse generating devices producing approximately equal current pulses.

2. A device according to claim 1, wherein the portions of conductors connected to a same pulse generating device are connected in series with each other, the connection parts of the conductors for the connection of the elongated portions with each other and for the connection to the respective pulse generating device are arranged so as to form together with said elongated portion a flat, practically closed loop for the generation of each of said magnetic field portions.

3. A device according to claim 1, comprising several groups of said portions of conductors in which said portions of conductors are connected in series with each other, each group being connected in its entirety to a respective pulse generating device, and at least one part of said groups being shifted one relatively to the others in the direction in which said successive magnetic field portions follow each other.

4. A device according to claim 1 for magnetizing transversally a flat body having two plane parallel surfaces and being of a small thickness as compared to the dimensions of these surfaces, wherein said portions of conductors are disposed in such a manner that each of said magnetic field portions is generated by at least eight portions of conductors disposed in pairs, the portions of each pair being placed parallel one close to the other, a first and a second pair being disposed in a first substantially flat space portion, and a third and a fourth pair being disposed in a similar way in a second substantially flat space portion and at a certain linear or angular distance from respectively the first and the second pair, each portion of conductor being connected in series with a portion of conductor of at least one adjoining pair of the same of said flat space portions.

5. A device according to claims 1, 2, 4 or 3, wherein said portions of electric conductors have a substantially rectangular, flat section, and are disposed in notches in a support of high magnetic permeability, which are deeper than wide, in such a manner that the edge of a portion of conductor disposed in the vicinity of the opening of the notch in which this portion is housed, is placed substantially at the same level as the edge of the notch.

6. A device according to claims 1, 2, 4 or 3, wherein several pulse generating devices are supplied in power in parallel from a same electric power source.

* * * * *